US012291828B2

(12) United States Patent
Ota et al.

(10) Patent No.: US 12,291,828 B2
(45) Date of Patent: May 6, 2025

(54) WORK MACHINE

(71) Applicant: HONDA MOTOR CO., LTD., Tokyo (JP)

(72) Inventors: Yoshitaka Ota, Wako (JP); Hajime Yoshimura, Wako (JP); Yuta Kimura, Wako (JP); Atsushi Moroi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 684 days.

(21) Appl. No.: 17/695,368

(22) Filed: Mar. 15, 2022

(65) Prior Publication Data

US 2022/0298736 A1 Sep. 22, 2022

(30) Foreign Application Priority Data

Mar. 18, 2021 (JP) ..... 2021-045145

(51) Int. Cl.
*E01H 5/09* (2006.01)

(52) U.S. Cl.
CPC ..... *E01H 5/098* (2013.01)

(58) Field of Classification Search
CPC ..... E01H 5/098; E01H 5/04; F16H 2059/465; F16H 2063/508; F16H 35/10; F16H 59/46
See application file for complete search history.

(56) References Cited

U.S. PATENT DOCUMENTS 5,768,811 A * 6/1998 Cooper ..... E02F 3/844 701/50
6,470,603 B2 * 10/2002 Hanafusa ..... F16D 48/064 56/11.4
7,096,608 B2 8/2006 Kuroiwa et al.
10,993,370 B2 * 5/2021 Arnold ..... A01D 34/535
2001/0008055 A1 * 7/2001 Sueshige ..... F16D 3/68 37/249

(Continued)

FOREIGN PATENT DOCUMENTS

JP S5329444 A 3/1978
JP S5744858 B2 9/1982

(Continued)

OTHER PUBLICATIONS

Japanese Office Action for Japanese Patent Application No. 2021045145 mailed Nov. 25, 2024 (partially translated).

*Primary Examiner* — Jamie L McGowan
(74) *Attorney, Agent, or Firm* — Thomas Horstemeyer, LLP

(57) ABSTRACT

A work machine includes: a drive rotation speed detector configured to detect a signal indicating a rotation of a drive source; a work rotation speed detector configured to detect a signal indicating rotation of a work rotation shaft; and a control device configured to, on the basis of comparison between signals acquired from the drive rotation speed detector and the work rotation speed detector, stop the drive source in a case where there is a rotation speed difference between a driven shaft in a rotating state due to power transmission from the drive source and the work rotation shaft. The work rotation speed detector includes: a detection target member configured to rotate together with the work rotation shaft; and a sensor mounting member configured to hold a detection sensor configured to detect rotation of the detection target member.

6 Claims, 7 Drawing Sheets

(56) References Cited

U.S. PATENT DOCUMENTS

| | | | | |
|---|---|---|---|---|
| 2004/0049953 | A1* | 3/2004 | Kuroiwa | E01H 5/04 477/178 |
| 2007/0022636 | A1* | 2/2007 | Wakitani | E01H 5/04 37/245 |
| 2009/0139194 | A1* | 6/2009 | Chervenka | F16H 61/66259 56/10.2 G |
| 2013/0066528 | A1* | 3/2013 | Kresse | F16H 59/38 701/54 |
| 2015/0107136 | A1* | 4/2015 | Fukano | E01H 5/04 37/235 |
| 2015/0316147 | A1* | 11/2015 | Aoki | F16H 37/021 74/664 |
| 2017/0066448 | A1* | 3/2017 | Hertel | B60L 3/10 |
| 2017/0114875 | A1* | 4/2017 | Yoshimura | F16H 63/06 |
| 2017/0114894 | A1* | 4/2017 | Yuki | B60W 30/1884 |
| 2019/0170231 | A1* | 6/2019 | Duan | F16H 63/065 |

FOREIGN PATENT DOCUMENTS

| | | | |
|---|---|---|---|
| JP | 2004-156424 | A | 6/2004 |
| JP | 2005-220606 | A | 8/2005 |

* cited by examiner

WORK MACHINE

CROSS-REFERENCE TO RELATED APPLICATION(S)

This application claims priority to and the benefit of Japanese Patent Application No. 2021-045145 filed on Mar. 18, 2021, the entire disclosure of which is incorporated herein by reference.

BACKGROUND OF THE INVENTION

Field of the Invention

The present invention relates to a work machine having a working section including an auger.

Description of the Related Art

Japanese Patent Laid-Open No. 2004-156424 discloses a snowblower that transmits power of a drive source to an auger and rotates the auger to remove snow.

However, in the configuration of Japanese Patent Laid-Open No. 2004-156424, the auger may bite into an ice block, a stone, or the like during the snow removal operation, thus the rotation of the auger may be stopped, and an overload may act on the power transmission path from the engine to the auger. Such an overload may lead to wear of consumables, requiring component replacement in a short period of time, or lead to wear of a friction member transmitting rotational torque, leading to slip of the friction member at a low torque. It is desirable to detect the overload state and stop the engine when the auger is in the overload state.

In view of the above problem, the present invention provides a work machine that stops a drive source in a case where there is a rotation speed difference between a driven shaft in a rotating state due to power transmission from the drive source and a work rotation shaft based on comparison of signals acquired from a drive rotation speed detector and a work rotation speed detector.

SUMMARY OF THE INVENTION

According to one aspect of the present invention, there is provided a work machine comprising: a drive source; a transmission mechanism configured to transmit rotation of the drive source; a driven rotary member configured to rotate a driven shaft in accordance with the rotation transmitted by the transmission mechanism; and a coupling mechanism configured to couple a work rotation shaft coupled to a working section and the driven shaft to each other via a friction member and transmit the rotation of the driven shaft to the work rotation shaft, wherein the work machine includes: a drive rotation speed detector configured to detect a signal indicating the rotation of the drive source; a work rotation speed detector configured to detect a signal indicating rotation of the work rotation shaft; and a control device configured to, on the basis of comparison between signals acquired from the drive rotation speed detector and the work rotation speed detector, stop the drive source in a case where there is a rotation speed difference between the driven shaft in a rotating state due to power transmission from the drive source and the work rotation shaft, wherein the work rotation speed detector includes: a detection target member configured to rotate together with the work rotation shaft; and a sensor mounting member configured to hold a detection sensor configured to detect rotation of the detection target member, and the sensor mounting member is coupled to a machine body frame of the work machine.

According to the present invention, a work machine that stops a drive source in a case where there is a rotation speed difference between a driven shaft in a rotating state due to power transmission from the drive source and a work rotation shaft based on comparison of signals acquired from a drive rotation speed detector and a work rotation speed detector can be provided.

DESCRIPTION OF THE EMBODIMENTS

Figure 1:
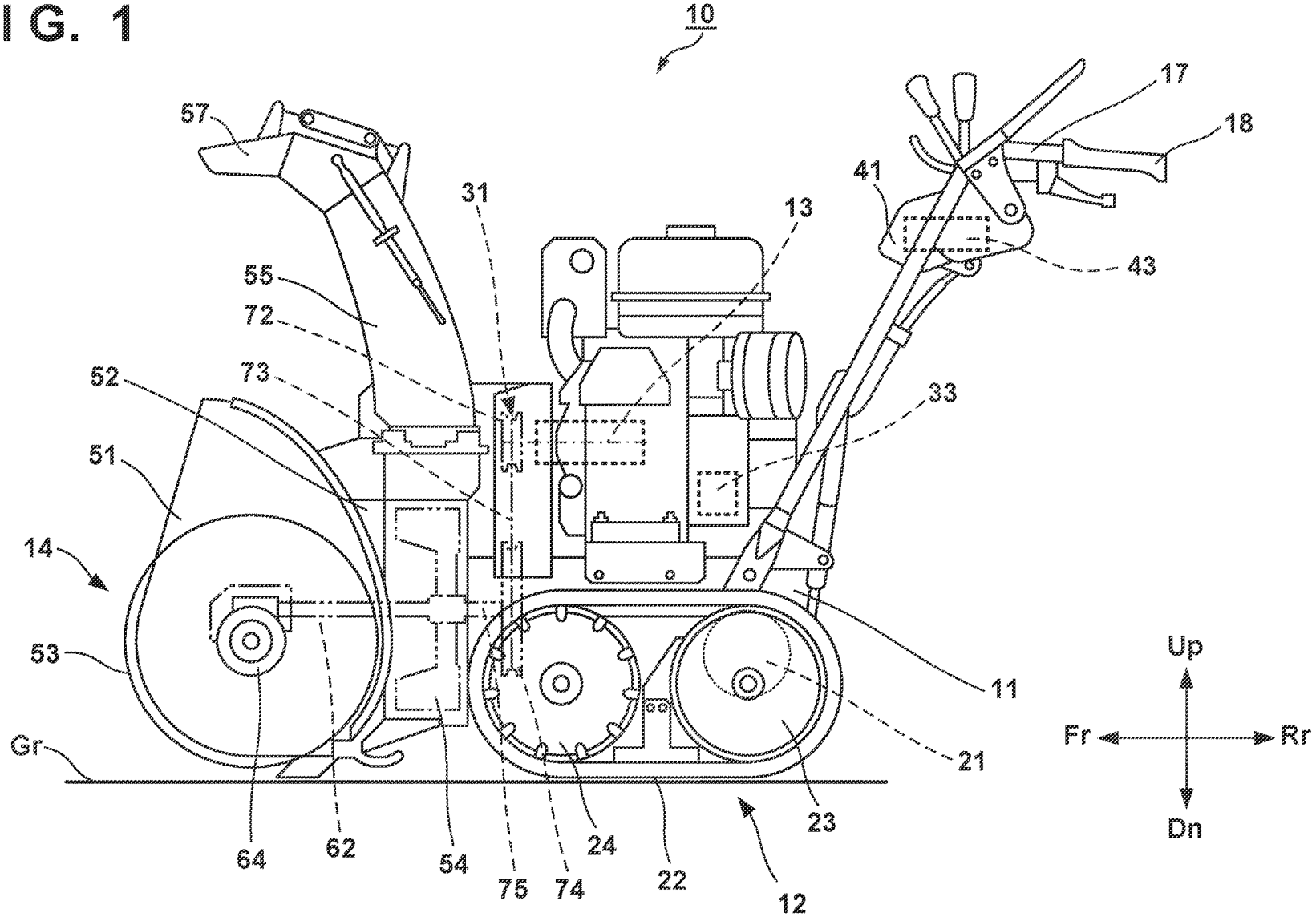
FIG. 1 is a side view of a work machine according to an embodiment of the present invention.

Hereinafter, embodiments will be described in detail with reference to the attached drawings. Note that the following embodiments are not intended to limit the scope of the claimed invention, and limitation is not made an invention that requires all combinations of features described in the embodiments. Two or more of the multiple features described in the embodiments may be combined as appropriate. Furthermore, the same reference numerals are given to the same or similar configurations, and redundant description thereof is omitted.

A configuration of the work machine according to an embodiment will be described with reference to drawings. The work machine can be applied to, for example, a walking auger snowblower. Note that the work machine can be applied to various work machines such as a lawn mower and a weeding device, and is not limited to the walking auger snowblower. "Front", "rear", "upper", "lower", "left", and "right" are directions as viewed from the operator, Fr indicates the front side, Rr indicates the rear side, Up indicates the upper side, Dn indicates the lower side, Lt indicates the left side, and Rt indicates the right side.

FIG. 1 is a side view of the work machine according to the embodiment. As illustrated in FIG. 1, a work machine 10 is a self-propelled auger snowblower (also referred to as a rotary snowblower) including a traveling frame 11 constituting a machine body of the entire work machine 10, left and right traveling devices 12 provided in the traveling frame 11, and a drive source 13 and a working section 14 integrally attached to the traveling frame 11.

Left and right operation handles 17 extending toward the upper-rear side are integrally attached to a rear portion of the traveling frame 11. Left and right grips 18 are attached to the distal ends of the left and right operation handles 17. The worker can steer the work machine 10 by the operation handles 17 while walking with the work machine 10.

The left and right traveling devices 12 are crawler traveling devices including left and right electric motors 21, left and right crawler belts 22, left and right drive wheels 23 disposed at the rear portion, and left and right rolling wheels 24 disposed at the front portion. The left and right crawler belts 22 can be driven via the left and right drive wheels 23 by the driving forces of the left and right electric motors 21.

As illustrated in FIG. 1, the drive source 13 is constituted by, for example, an engine. Hereinafter, the drive source 13 will be also referred to as an engine. The drive source 13 drives the working section 14 via a power transmission mechanism 31, and drives an internal generator of the work machine 10 to supply electric power obtained from the internal generator to a battery 33, the left and right electric motors 21, and other electric components. The left and right electric motors 21 are driven by electric power generated by the internal generator and electric power of the battery 33.

The control system of the work machine 10 is integrated around a control unit 43 (control device) provided inside an operation unit 41. The control unit 43 incorporates a memory (storage unit), and appropriately loads various kinds of information or programs stored in the memory (storage unit) to control the work machine.

The working section 14 includes an auger housing 51, a blower case 52 integrally provided on the back surface of the auger housing 51, an auger 53 provided in the auger housing 51, a blower 54 provided in the blower case 52, and a shooter 55 extending upward from an upper portion of the blower case 52.

The shooter 55 is a so-called snow throwing section used for blowing snow scraped by the auger 53 to a position away from the work machine 10 by the blower 54. A proximal end portion of the shooter 55 is rotatably attached to the blower case 52 approximately horizontally so as to adjust a snow throwing direction, that is, a direction in which the snow is thrown. Therefore, the shooter 55 is rotatable substantially parallel to a ground contact surface Gr on which the traveling device 12 is in contact with the ground. The shooter 55 is driven by a shooter driving motor.

A shooter guide 57 is provided at an upper end portion of the shooter 55. The shooter guide 57 is attached to the upper end portion of the shooter 55 in such a manner as to be swingable in an up-down direction so as to adjust the snow throwing angle in the up-down direction. The shooter guide 57 is swingably driven by a guide driving motor.

As illustrated in FIG. 1, the work machine 10 can scrape snow by the auger 53 in the front portion while traveling forward by the left and right traveling devices 12, and blow the scraped snow away via the shooter 55 by the blower 54.

(Control System of Work Machine 10)

Figure 2:
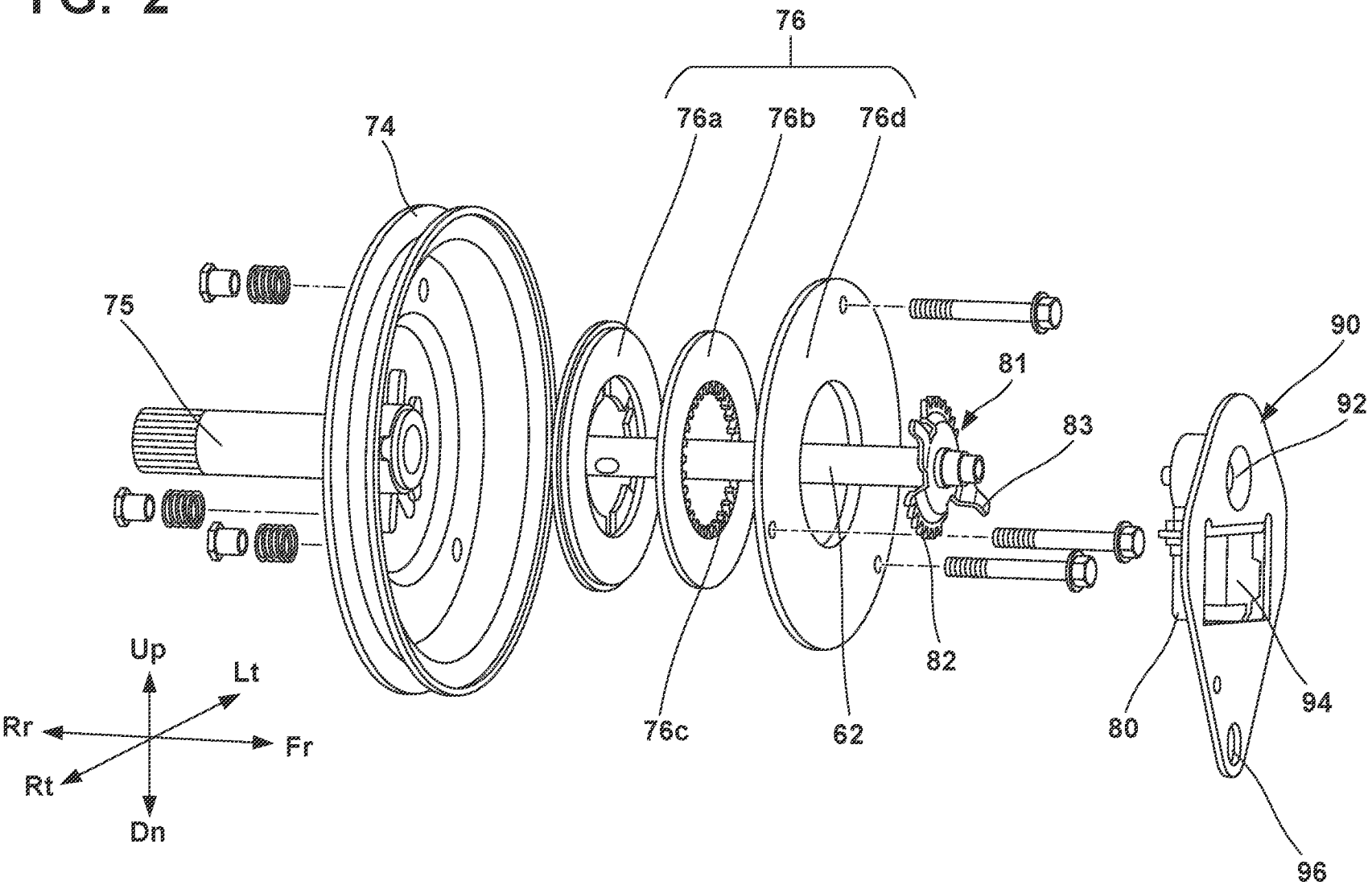
FIG. 2 is a diagram for describing a structure of a detection target member and a structure of a sensor mounting member.
Figure 6:
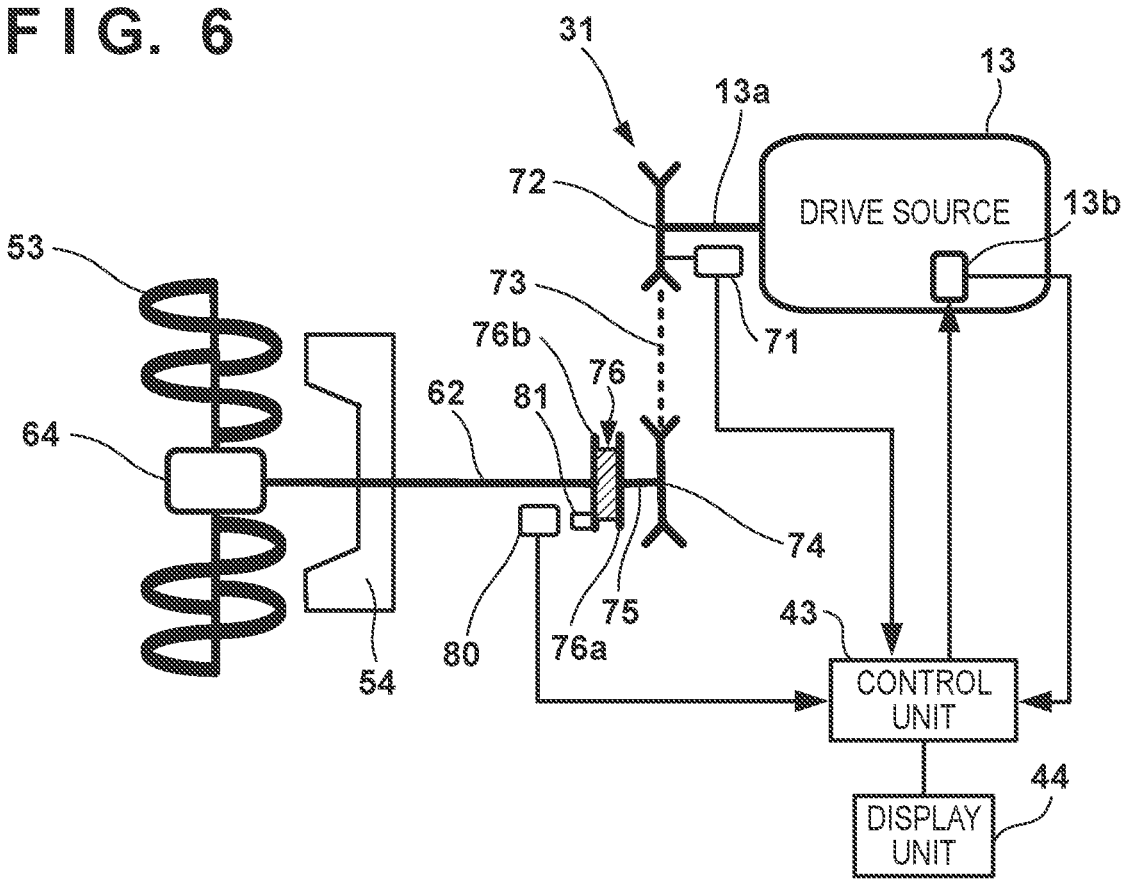
FIG. 6 is a diagram schematically illustrating a control system of the work machine according to the embodiment.

FIG. 2 is a diagram for describing the structure of a detection target member 81 and the structure of a sensor mounting member 90, and FIG. 6 is a diagram schematically illustrating a control system of the work machine 10. Here, the power transmission mechanism 31 includes a driving pulley 72 coupled to an output shaft 13*a* (driving shaft) of the drive source 13, a driven pulley 74 (driven rotary member) coupled to a driven shaft 75, and a V belt 73 stretched between the driving pulley 72 and the driven pulley 74, and is configured to be able to change a reduction ratio of the driven pulley 74 with respect to the driving pulley 72. The power transmission mechanism 31 transmits rotation (rotational force) of the drive source 13 to a driven rotation mechanism (driven shaft 75 and driven pulley 74 (driven rotary member)).

As illustrated in FIG. 2, a coupling portion 76 (coupling mechanism) includes friction members 76*a* and 76*d* coupled to the driven shaft 75 and a friction member 76*b* coupled to the work rotation shaft 62. The coupling portion 76 couples the work rotation shaft 62, which is coupled to the working section 14, and the driven shaft 75 to each other via the friction members (76*a*, 76*b*, and 76*d*), and transmits the rotation of the driven shaft 75 to the work rotation shaft 62. The work rotation shaft 62 coupled to the auger 53 and the blower 54 is concentrically coupled to the driven shaft 75 via the coupling portion 76. In FIG. 6, the friction member 76*d* is omitted for easy understanding of the positional relationship between a detection target member 81 and a work rotation speed detection unit 80 (detection sensor).

The working section 14 includes the auger 53 that is rotatable on the basis of the rotation transmitted by the work rotation shaft 62. The working section 14 is coupled to the driven shaft 75 via the work rotation shaft 62 and a coupling portion 76 (friction members (76*a*, 76*b*, and 76*d*)). The auger 53 is coupled to the work rotation shaft 62 via a worm gear-type speed reduction mechanism 64, and the rotation of the driven shaft 75 is transmitted to the auger 53 via the coupling portion 76, the work rotation shaft 62, and the worm gear-type speed reduction mechanism 64.

The work rotation speed detection unit 80 (detection sensor) detects a rotation speed which is the rotation speed of the work rotation shaft 62. The work rotation speed detection unit 80 (detection sensor) detects the rotation of the detection target member 81 (a detection target pulser portion 83) coupled to the friction member 76*b* to detect the rotation speed of the work rotation shaft 62 coupled to the friction member 76*b*. The work rotation speed detection unit 80 (detection sensor) includes a pulser coil that detects a signal generated by the rotation of the detection target pulser portion 83. A signal indicating the rotation speed of the work rotation shaft 62 can be easily detected by using a pulser coil.

The work rotation speed detection unit 80 (detection sensor) inputs a detection signal (pulse signal) to the control unit 43. As will be described later with reference to FIG. 5, the work rotation speed detection unit 80 (detection sensor) is attached to a sensor mounting member 90, and is attached to a machine body frame 500 of the work machine 10 via the sensor mounting member 90. In the present embodiment, the configuration for detecting the rotation speed of the work rotation shaft 62 is not limited to the work rotation speed detection unit 80 (detection sensor) and the detection target member 81 (detection target pulser portion 83), and any configurations may be used as long as the configuration can detect the rotation speed of the work rotation shaft 62.

The rotation shaft of the driving pulley 72 is coupled to an electromagnetic clutch, and when a clutch switch 71 is in an OFF state, the rotation shaft of the driving pulley 72 is released with respect to the output shaft 13*a* of the drive source 13. When the clutch switch 71 is turned into an ON state, the rotation shaft of the driving pulley 72 is coupled to the output shaft 13*a* of the drive source 13, and it becomes possible to transmit the rotation of the drive source 13. A state signal indicating the state (OFF state or ON state) of the clutch switch 71 is input to the control unit 43. The control unit 43 can determine whether the rotation shaft of the driving pulley 72 and the output shaft 13*a* of the drive source 13 are in a coupled state or a released state on the basis of the state signal from the clutch switch 71.

An ignition processing device 13*b* (D-CDI) of the drive source 13 functions as a drive rotation speed detection unit (drive rotation speed detector) that detects a signal indicating the rotation of the drive source 13. The ignition processing device 13*b* (D-CDI) detects a signal indicating the rotation speed of the drive source 13 (engine) and inputs a detection signal to the control unit 43.

The control unit 43 determines whether or not the auger 53 is in a locked state by comparing the detection signal detected by the work rotation speed detection unit 80 (detection sensor) with the detection signal detected by the ignition processing device 13*b* (D-CDI).

Figure 7:
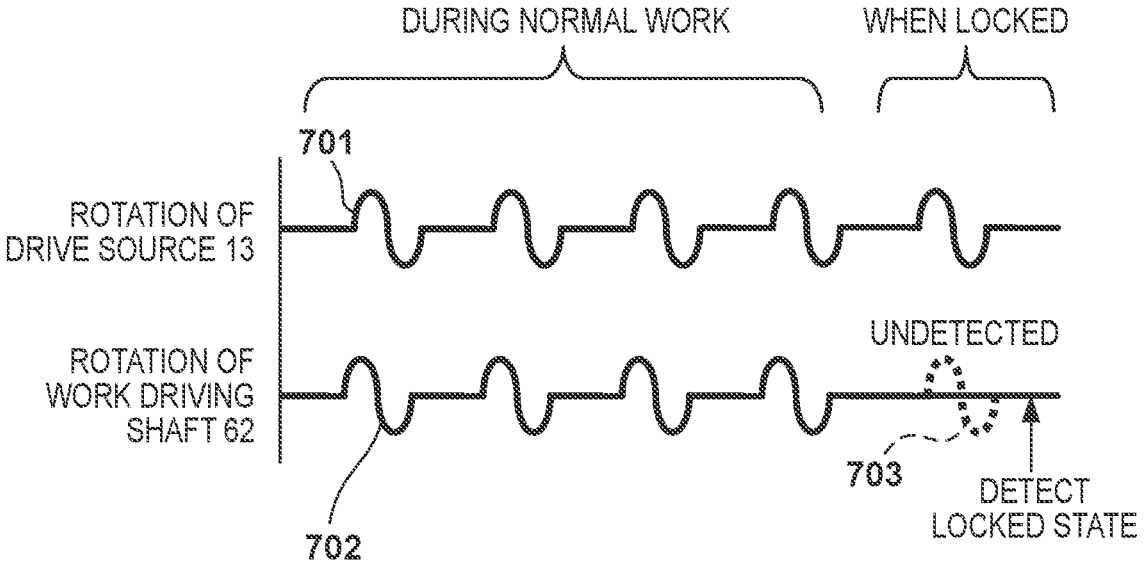
FIG. 7 is a diagram illustrating a detection example of a detection signal indicating the rotation of a drive source and a detection signal indicating the rotation of a work rotation shaft.

FIG. 7 is a diagram illustrating a detection example of a detection signal 701 indicating the rotation of the drive source 13 and a detection signal 702 indicating the rotation of the work rotation shaft 62.

When no overload acts on the auger 53 (during normal work of the work machine 10), the driven shaft 75 coupled to the driven pulley 74 and the work rotation shaft 62 rotate at the same rotation speed, and a relative rotation speed difference (differential rotation) does not occur between the driven pulley 74 (driven shaft 75) and the work rotation shaft 62. The detection signal 701 indicating the rotation of the drive source 13 and the detection signal 702 indicating the rotation of the work rotation shaft 62 are detected as synchronized signals.

In contrast, when the auger 53 is locked while the work machine 10 is working, the work rotation shaft 62 turns into a rotation stopped state although the drive source 13 generates rotation. That is, during normal work, the detection signal 703 to be detected is undetected. The driven shaft 75 coupled to the driven pulley 74 is rotated by the power transmission from the drive source 13, and a relative rotation speed difference (differential rotation) is generated between the driven pulley 74 (driven shaft 75) in the rotating state and the work rotation shaft 62 in the stopped state. When the detection signal 703 indicating the rotation of the work rotation shaft 62 is not detected by the work rotation speed detection unit 80 (detection sensor) although the detection signal 701 indicating the rotation of the drive source 13 is detected by the ignition processing device 13*b* (D-CDI), the control unit 43 determines that the auger 53 is in the locked state.

In the case where it is determined that the auger 53 is in the locked state, the control unit 43 generates a control signal for stopping the drive source 13 and transmits the control signal to the ignition processing device 13*b* (D-CDI), and the ignition processing device 13*b* (D-CDI) performs an engine extinguishing process for stopping the drive source 13 on the basis of the control signal received from the control unit 43. Although a configuration example of detecting the rotation of the drive source 13 has been described with reference to FIG. 6, the rotation of the driven pulley 74 or the driven shaft 75 may be detected.

Figure 8:
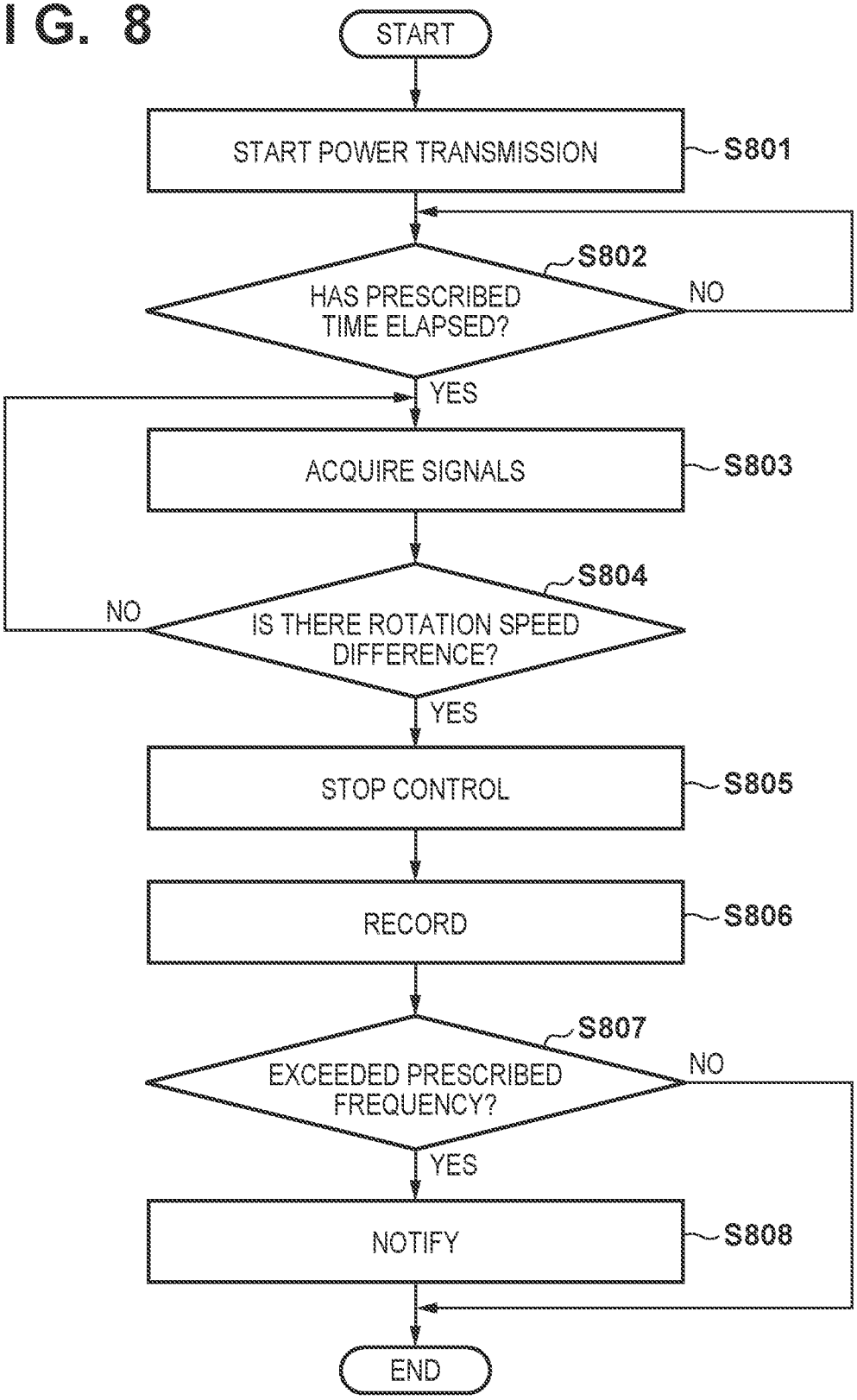
FIG. 8 is a diagram for describing a flow of processing of a control unit in the work machine according to the embodiment.

FIG. 8 is a diagram for describing a flow of processing of the control unit 43 in the work machine 10.

In S801, the control unit 43 determines whether the rotation shaft of the driving pulley 72 and the output shaft 13*a* of the drive source 13 are in the coupled state or the released state on the basis of the state signal from the clutch switch 71, and when the clutch switch 71 is turned into the ON state, the rotation shaft of the driving pulley 72 is coupled to the output shaft 13*a* of the drive source 13, and the power transmission in which the rotation of the drive source 13 can be transmitted is started.

In step S802, the control unit 43 determines whether or not a prescribed time has elapsed since the clutch switch 71 has been turned into the ON state. When the prescribed time has not elapsed (S802—No), the control unit 43 takes a standby state until the prescribed time elapses. In contrast, after the elapse of the prescribed time (S802—Yes), the control unit 43 advances the processing to S803.

In S803, the control unit 43 acquires signals from the ignition processing device 13*b* (D-CDI) and the work rotation speed detection unit 80 (detection sensor). Then, the control unit 43 determines, on the basis of comparison of the acquired signals, whether or not there is a rotation speed difference (differential rotation) between the driven pulley 74 (driven shaft 75) that is in the rotating state due to the power transmission from the drive source 13 and the work rotation shaft 62. When there is no rotation speed difference (S804—No), the processing returns to S803, and the signal acquisition processing is continued. In contrast, when there is a rotation speed difference (S804—Yes), the control unit 43 advances the processing to S805.

In S805, the control unit 43 performs stop control. That is, the control unit 43 determines that the auger 53 is in the locked state, generates a control signal for stopping the drive source 13, and transmits the control signal to the ignition processing device 13*b* (D-CDI), and the ignition processing device 13*b* (D-CDI) performs an engine extinguishing process for stopping the drive source 13 on the basis of the control signal received from the control unit 43. In addition, in the case where it is determined that the auger 53 is in the locked state, the control unit 43 controls the display of the display unit 44 to notify the operator that the auger 53 is in the locked state (a state in which there is differential rotation between the rotation speed of the driven shaft 75 and the rotation speed of the work rotation shaft 62). As the display control of the display unit 44, the control unit 43 can blink a light-emitting diode (LED) display, change the display color, or display notification information on the display of the display unit 44.

In step S806, the control unit 43 stores lock occurrence information indicating the occurrence of the locked state in the memory (storage unit). At this time, the control unit 43 refers to information of an internal clock, and stores date and time information of occurrence of the locked state in combination with the lock occurrence information.

In S807, the control unit 43 determines whether or not the occurrence frequency of the locked state exceeds a prescribed frequency on the basis of the lock occurrence information and the date and time information stored in the memory (storage unit). When the occurrence frequency of the locked state does not exceed the prescribed frequency (S807—No), the process is finished. In contrast, when the occurrence frequency of the locked state exceeds the prescribed frequency (S807—Yes), the control unit 43 advances the processing to S808.

In S808, the control unit 43 acquires the detection signal 701 indicating the rotation of the drive source 13 and the detection signal 702 indicating the rotation of the work rotation shaft 62, and notifies the operator (user) of maintenance information. For example, the control unit 43 can also notify the operator of information requesting replacement of a consumable part.

(Structure of Detection Target Member 81)

Figure 3:
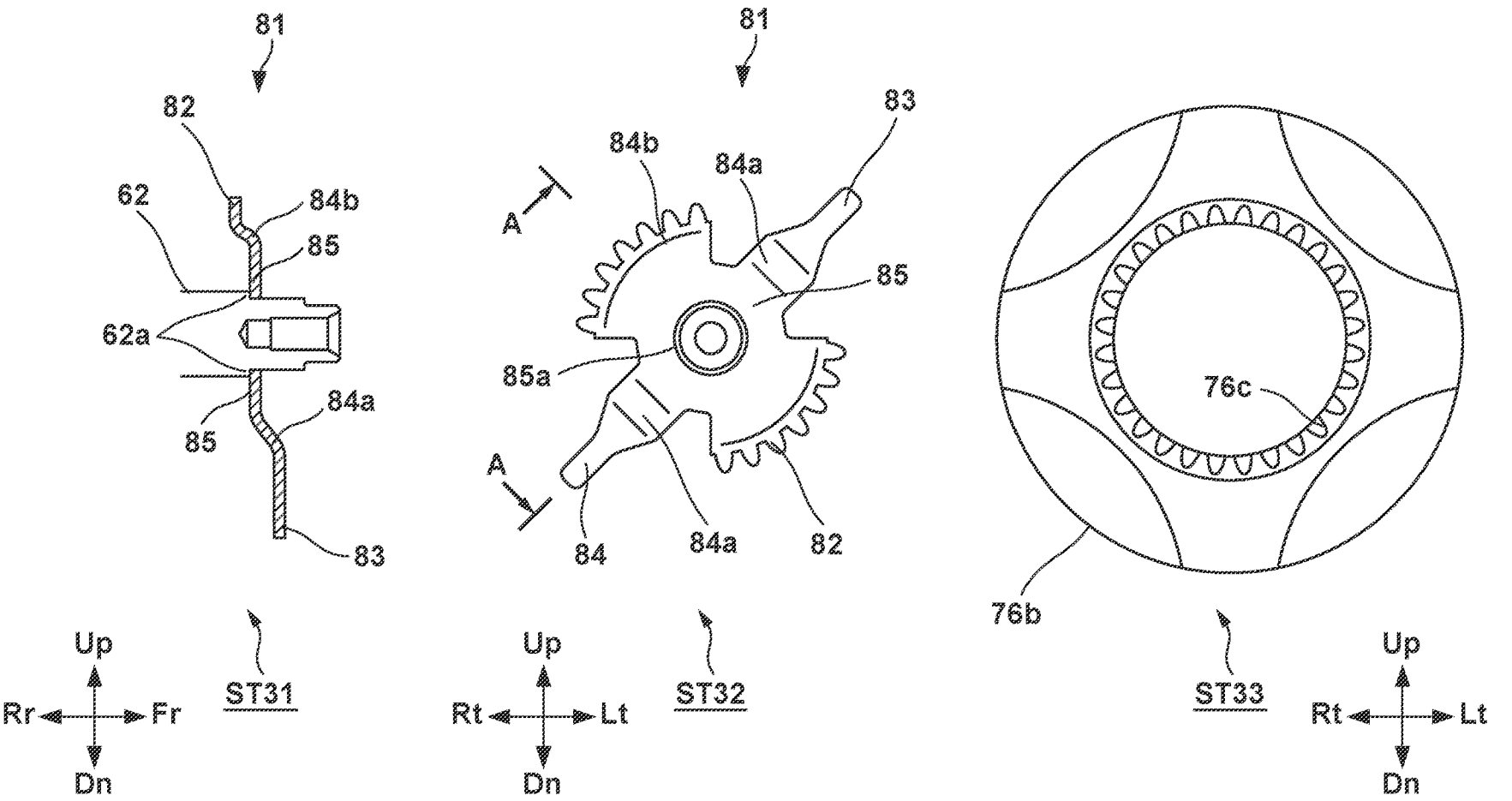
FIG. 3 is a diagram for describing a structure of the detection target member.

FIG. 2 is a diagram for describing the structure of the detection target member 81 and the structure of the sensor mounting member 90, and FIG. 3 is a diagram for describing a structure of the detection target member 81. ST32 of FIG. 3 is a front view of the detection target member 81 as viewed from the working section 14 side, and ST31 of FIG. 3 is a side view of the detection target member 81 in an A-A cross section of ST32. ST33 of FIG. 3 is a front view of the friction member 76*b* as viewed from the working section 14 side, and groove portions 76*c* are provided in an inner peripheral portion of a hollow shape of the friction member 76*b*. The groove portions 76*c* engage with a spline formed on the outer peripheral surface of the work rotation shaft 62, and thus the friction member 76*b* is coupled to the work rotation shaft 62.

The detection target member 81 includes an inner peripheral portion 85*a*, a flat portion 85, a first inclined portion 84*a*, a second inclined portion 84*b*, an engaging portion 82, and a detection target pulser portion 83. The inner peripheral portion 85*a* of the detection target member 81 is fixed to a stepped portion 62*a* formed on a part of the outer peripheral portion of the work rotation shaft 62 by welding. Note that the method of fixation is not limited to fixation by welding (integration), and for example, the inner peripheral portion 85*a* of the detection target member 81 may be configured to be integrally fitted to the stepped portion 62*a* formed in a part of the outer peripheral portion of the work rotation shaft 62. The flat portion 85 of the detection target member 81 is provided to extend from the inner peripheral portion 85*a* in the radial direction of the work rotation shaft 62. The first inclined portion 84*a* is formed to be inclined from an end portion of the flat portion 85 toward the work rotation speed detection unit 80 side (detection sensor side) (front side of the work machine 10), and the detection target pulser portion 83 is provided to extend from an end portion of the first inclined portion 84*a* in the radial direction of the work rotation shaft 62. The detection target pulser portion 83 is formed substantially parallel to the flat portion 85. The work rotation speed detection unit 80 (detection sensor) detects a signal derived from the rotation of the detection target pulser portion 83.

The second inclined portion 84*b* is formed to be inclined from an end portion of the flat portion 85 toward the friction member side (friction member 76*b* side, rear side of work machine 10), and the engaging portion 82 is provided to extend in the radial direction of the work rotation shaft 62 from an end portion of the second inclined portion 84*b*. The engaging portion 82 is formed substantially parallel to the flat portion 85. The engaging portion 82 is coupled to the friction member 76*b* by engaging with the groove portions 76*c* (part of the groove portions 76*c*) formed in the inner peripheral portion of the friction member 76*b*.

With such a configuration of the detection target member 81, it is possible to bring the detection target pulser portion 83 close to the work rotation speed detection unit 80 (detection sensor) side, bring the engaging portion 82 close to the friction member 76*b*, and couple the engaging portion 82 to the friction member 76*b*, and thus, it is possible to miniaturize the device configuration of the work machine 10.

(Structure of Sensor Mounting Member 90)

Figure 4:
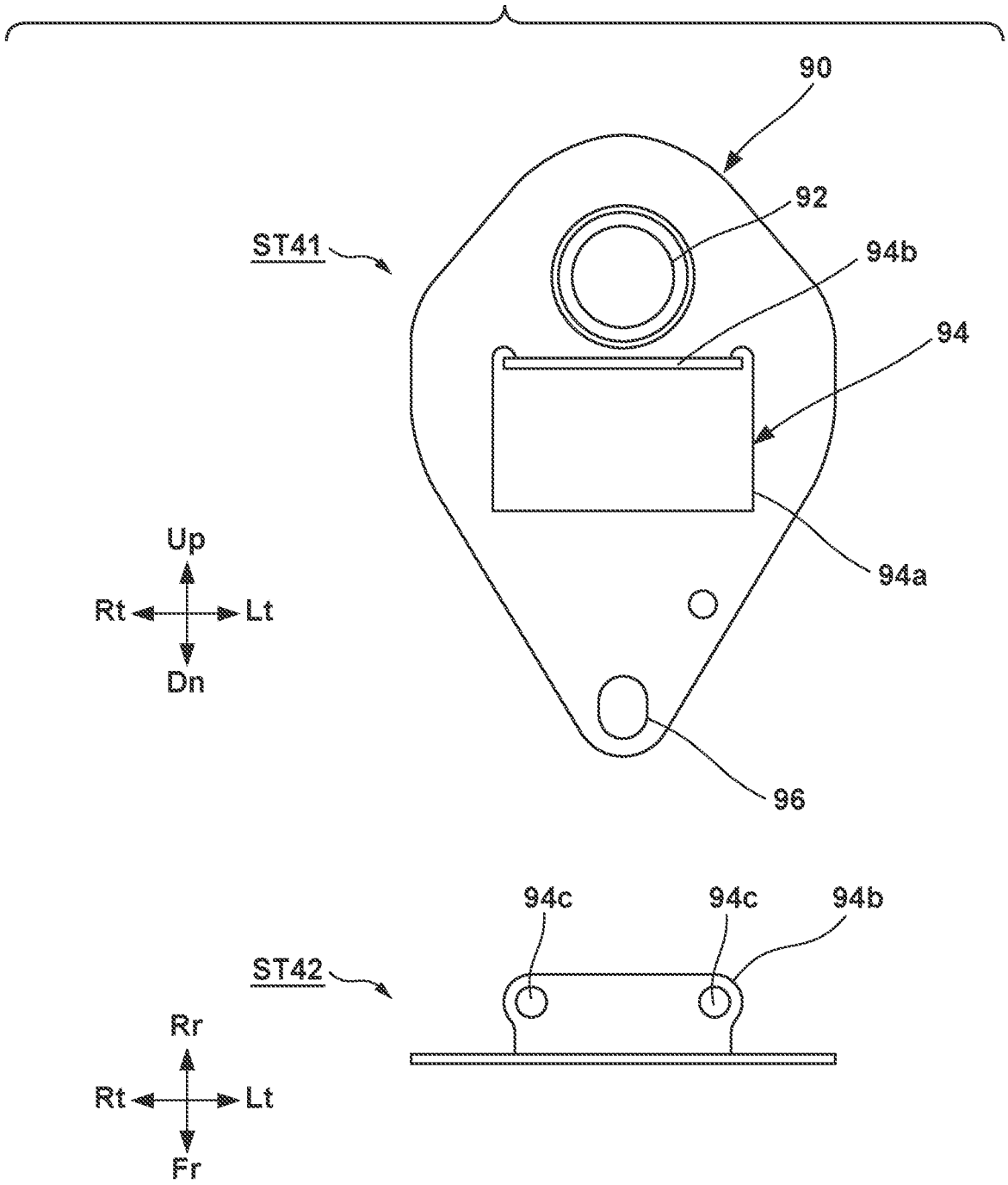
FIG. 4 is a diagram for describing a structure of the sensor mounting member.

Next, a structure of the sensor mounting member 90 will be described. FIG. 4 is a diagram for describing the structure of the sensor mounting member 90. ST41 of FIG. 4 is a front view of the sensor mounting member 90 as viewed from the working section 14 side, and ST42 of FIG. 4 is a view of the sensor mounting member 90 of ST41 as viewed from below. In the sensor mounting member 90, a bearing holding portion 92, a sensor holding portion 94, and a frame coupling portion 96 (frame coupling opening) are formed in a single member.

The bearing holding portion 92 holds a bearing that rotatably supports the work rotation shaft 62. The sensor holding portion 94 has an opening 94*a* formed in a single member, and a flange portion 94*b* formed by bending a part of the single member, and screw holes 94*c* for engaging with fastening members 520 such as bolts are formed in the flange portion 94*b*. A sensor flange portion 80*b* (FIG. 5) is provided in the work rotation speed detection unit 80 (detection sensor) at a position facing the flange portion 94*b*. Through holes are formed in the sensor flange portion 80*b* at positions matching the positions of the screw holes 94*c* of the flange portion 94*b*. When the fastening members 520 engage with the screw holes 94*c* of the flange portion 94*b* via the through holes of the sensor flange portion 80*b*, the work rotation speed detection unit 80 (detection sensor) is held by the sensor holding portion 94. The sensor holding portion 94 holds the work rotation speed detection unit 80 (detection sensor) disposed in opening 94*a* on the flange portion 94*b* by the fastening members. The frame coupling portion 96 is an opening for coupling the sensor mounting member 90 to the machine body frame 500 (FIG. 5) of the work machine 10 via a fastening member 510 (FIG. 5).

Figure 5:
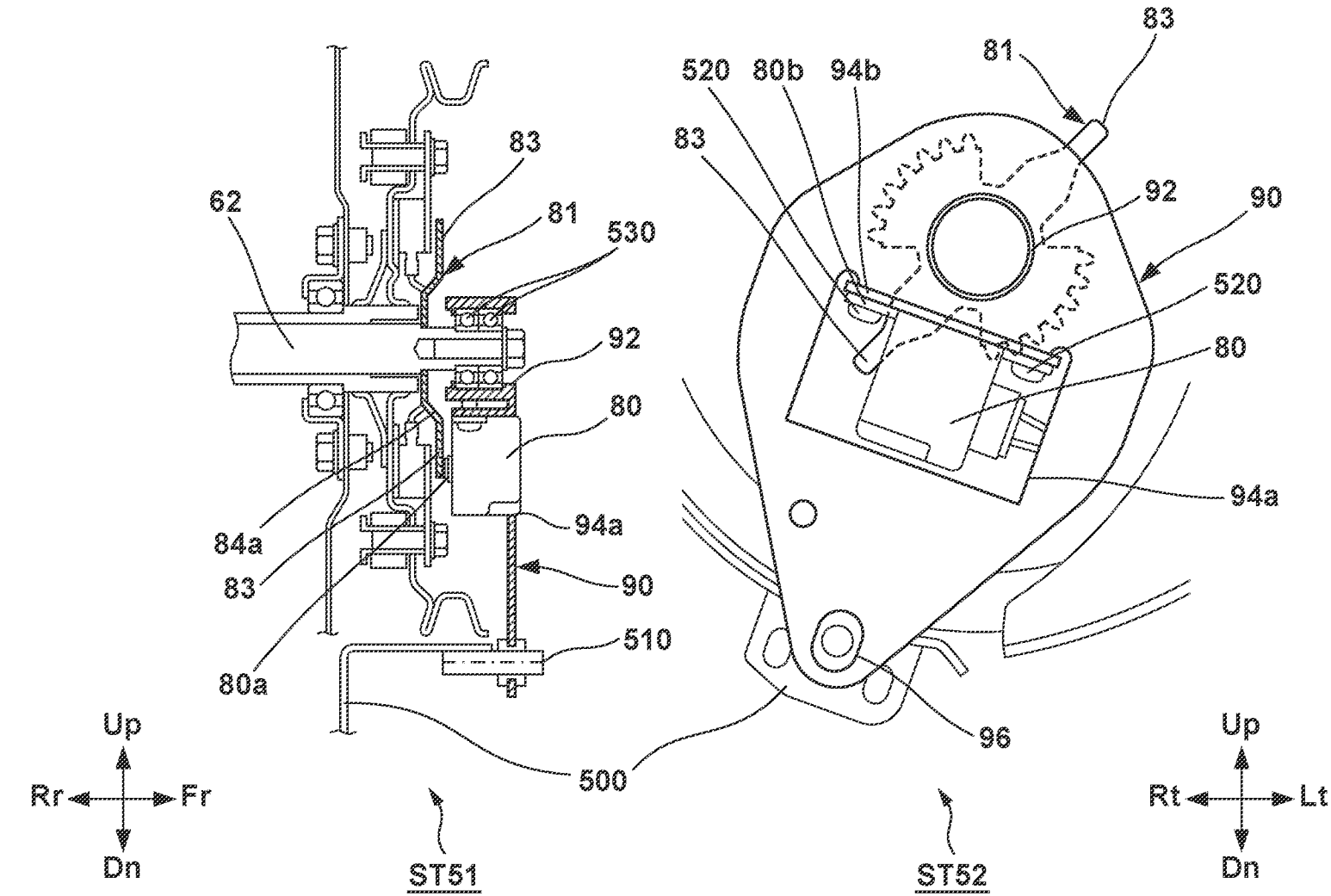
FIG. 5 is a diagram for describing a positional relationship between a work rotation speed detection unit (detection sensor) attached to the sensor mounting member and the detection target member.

FIG. 5 is a diagram for describing a positional relationship between the work rotation speed detection unit (detection sensor) 80 attached to the sensor mounting member 90 and the detection target member 81. ST52 in FIG. 5 is a front view illustrating a positional relationship viewed from the working section 14 side, and ST51 in FIG. 5 is a side view illustrating the positional relationship.

The bearing holding portion 92 holds a bearing 530 that rotatably supports the work rotation shaft 62. A work rotation speed detection unit 80 (detection sensor) is disposed in the opening 94*a* of the sensor holding portion 94. The frame coupling portion 96 is an opening for coupling the sensor mounting member 90 to the machine body frame 500 of the work machine 10 via the fastening member 510. The fastening member 510 coupled to the machine body frame 500 of the work machine 10 is inserted into the frame coupling portion 96 (frame coupling opening), the left and right sides of the sensor mounting member 90 are fastened (coupled) to the fastening member 510 by a member such as a screw or a snap ring, and thus the sensor mounting member 90 is fastened (coupled) to the machine body frame 500 of the work machine 10 via the fastening member 510.

As illustrated in ST51 of FIG. 5, the detection target pulser portion 83 of the detection target member 81 is disposed in the vicinity of the pulser detection portion 80*a* of the work rotation speed detection unit 80 (detection sensor) held by the sensor mounting member 90 while avoiding interference with the bearing holding portion 92. According to the configuration of the detection target member 81 and the sensor mounting member 90 of the present embodiment, it is possible to miniaturize the device configuration of the work machine 10 while avoiding interference with the detection target member 81 that rotates with the rotation of the work rotation shaft 62. In addition, according to the configuration of the sensor mounting member 90, the three functions of holding the bearing 530, holding the work rotation speed detection unit 80, and coupling the sensor mounting member 90 to the machine body frame 500 can be realized by a single component (member), and the manufacturing cost of the work machine 10 can be reduced by reducing the number of components.

(Summary of Embodiment)

The above-described embodiment at least discloses a work machine described as follows.

Configuration 1. The work machine according to the embodiment described above is a work machine including:

a drive source (13);

a transmission mechanism (31) configured to transmit rotation of the drive source;

a driven rotary member (74) including a driven shaft (75) configured to rotate in accordance with the rotation transmitted by the transmission mechanism; and a coupling mechanism (76) configured to couple a work rotation shaft (62) coupled to a working section (14) and the driven shaft (75) to each other via a friction member and transmit the rotation of the driven shaft (75) to the work rotation shaft (62), in which the work machine includes:

a drive rotation speed detector (13*b*) configured to detect a signal indicating the rotation of the drive source;

a work rotation speed detector (80, 81, and 90) configured to detect a signal indicating rotation of the work rotation shaft; and a control device (43) configured to, on the basis of comparison between signals acquired from the drive rotation speed detector and the work rotation speed detector, stop the drive source in a case where there is a rotation speed difference between the driven shaft in a rotating state due to power transmission from the drive source and the work rotation shaft, in which the work rotation speed detector (80, 81, and 90) includes:

a detection target member (81) configured to rotate together with the work rotation shaft; and a sensor mounting member (90) configured to hold a detection sensor (80) configured to detect rotation of the detection target member, and the sensor mounting member (90) is coupled to a machine body frame (500) of the work machine.

According to the work machine of Configuration 1, a drive source can be stopped in a case where there is a rotation speed difference between a driven shaft in a rotating state due to power transmission from the drive source and a work rotation shaft based on comparison of signals acquired from a drive rotation speed detector and a work rotation speed detector can be provided. This makes it possible to prevent wear of the friction member.

Configuration 2. In the work machine according to the embodiment described above, the detection target member (81) includes:

an inner peripheral portion (85*a*) fixed to a stepped portion (62*a*) formed in a part of an outer peripheral portion of the work rotation shaft (62);

a flat portion (85) provided to extend from the inner peripheral portion (85*a*) in a radial direction of the work rotation shaft (62);

a first inclined portion (84*a*) formed to be inclined toward the detection sensor (80) from an end portion of the flat portion (85); and a detection target pulser portion (83) provided to extend from an end portion of the first inclined portion (84*a*) in the radial direction of the work rotation shaft (62), and the detection sensor (80) detects a signal derived from rotation of the detection target pulser portion (83).

Configuration 3. In the work machine according to the embodiment described above, the detection target member (81) includes:

a second inclined portion (84*b*) formed to be inclined from an end portion of the flat portion (85) toward a friction member (76*b*) coupled to the work rotation shaft (62); and an engaging portion (82) provided to extend from an end portion of the second inclined portion (84*b*) in the radial direction of the work rotation shaft (62), and the engaging portion (82) is coupled to the friction member (76*b*) by engaging with a groove portion (76*c*) formed in an inner peripheral portion of the friction member (76*b*) coupled to the work rotation shaft (62).

According to the work machine of Configuration 2 and Configuration 3, it is possible to bring the detection target pulser portion close to the work rotation speed detection unit (detection sensor) side, bring the engaging portion close to the friction member coupled to the work rotation shaft, and couple the engaging portion to the friction member, and thus, it is possible to miniaturize the device configuration of the work machine.

Configuration 4. In the work machine according to the embodiment described above, the sensor mounting member (90) includes:

a bearing holding portion (92) configured to hold a bearing (530) rotatably supporting the work rotation shaft (62); and a sensor holding portion (94) configured to hold the detection sensor (80); and a frame coupling portion (96) configured to couple the sensor mounting member (90) to the machine body frame (500) of the work machine (10).

Configuration 5. In the work machine according to the embodiment described above, the sensor mounting member is constituted by a single member, the sensor holding portion (94) includes an opening (94*a*) formed in the single member and a flange portion (94*b*) formed by bending a part of the single member, and the sensor holding portion (94) holds, on the flange portion (94*b*) and by a fastening member, the detection sensor (80) disposed in the opening (94*a*).

According to the work machine of Configuration 4 and Configuration 5, three functions of holding the bearing, holding the work rotation speed detection unit (detection sensor), and coupling the sensor mounting member to the machine body frame can be realized by a single component (member), and the manufacturing cost of the work machine can be reduced by reducing the number of components.

Configuration 6. In the work machine according to the embodiment described above, the detection sensor (80) includes a pulser coil configured to detect a signal derived from rotation of the detection target pulser portion (83).

According to the work machine of Configuration 6, a signal indicating the rotation speed of the work rotation shaft can be easily detected by using a pulser coil.

Configuration 7. In the work machine according to the embodiment described above, the working section (14) includes an auger (53) capable of rotating on the basis of rotation transmitted by the work rotation shaft (62).

According to the work machine of Configuration 7, overload acting on the auger in the working section can be reduced, and the auger can be protected. As a result, it is possible to prevent wear of parts that transmit power to the auger.

The invention is not limited to the foregoing embodiments, and various variations/changes are possible within the spirit of the invention.

What is claimed is:

1. A work machine comprising:

a drive source;

a transmission mechanism configured to transmit rotation of the drive source;

a driven rotary member configured to rotate a driven shaft in accordance with the rotation transmitted by the transmission mechanism; and a coupling mechanism configured to couple a work rotation shaft coupled to a working section and the driven shaft to each other via a friction member and transmit the rotation of the driven shaft to the work rotation shaft, wherein the work machine includes:

a drive rotation speed detector configured to detect a signal indicating the rotation of the drive source;

a work rotation speed detector configured to detect a signal indicating rotation of the work rotation shaft; and a control device configured to, on the basis of comparison between signals acquired from the drive rotation speed detector and the work rotation speed detector, stop the drive source in a case where there is a rotation speed difference between the driven shaft in a rotating state due to power transmission from the drive source and the work rotation shaft, wherein the work rotation speed detector includes:

a detection target member configured to rotate together with the work rotation shaft; and a sensor mounting member configured to hold a detection sensor configured to detect rotation of the detection target member, the sensor mounting member is coupled to a machine body frame of the work machine, wherein the detection target member includes:

an inner peripheral portion fixed to a stepped portion formed in a part of an outer peripheral portion of the work rotation shaft;

a flat portion provided to extend from the inner peripheral portion in a radial direction of the work rotation shaft;

a first inclined portion formed to be inclined toward the detection sensor from an end portion of the flat portion; and a detection target pulser portion provided to extend from an end portion of the first inclined portion in the radial direction of the work rotation shaft, and the detection sensor detects a signal derived from rotation of the detection target pulser portion.

2. The work machine according to claim 1, wherein the detection target member includes:

a second inclined portion formed to be inclined from an end portion of the flat portion toward a friction member coupled to the work rotation shaft; and an engaging portion provided to extend from an end portion of the second inclined portion in the radial direction of the work rotation shaft, and the engaging portion is coupled to the friction member by engaging with a groove portion formed in an inner peripheral portion of the friction member coupled to the work rotation shaft.

3. The work machine according to claim 1, wherein the sensor mounting member includes:

a bearing holding portion configured to hold a bearing rotatably supporting the work rotation shaft; and a sensor holding portion configured to hold the detection sensor; and a frame coupling portion configured to couple the sensor mounting member to the machine body frame of the work machine.

4. The work machine according to claim 3, wherein the sensor mounting member is constituted by a single member, the sensor holding portion includes an opening formed in the single member and a flange portion formed by bending a part of the single member, and the sensor holding portion holds, on the flange portion and by a fastening member, the detection sensor disposed in the opening.

5. The work machine according to claim 1, wherein the detection sensor includes a pulser coil configured to detect a signal derived from rotation of the detection target pulser portion.

6. The work machine according to claim 1, wherein the working section includes an auger capable of rotating on the basis of rotation transmitted by the work rotation shaft.

* * * * *